United States Patent [19]

Kleber

[11] 4,198,202

[45] Apr. 15, 1980

[54] METHOD OF PRODUCING EDGE-PRINTED FABRIC GARMENT PIECES

[76] Inventor: Kürt Kleber, Sofienstrasse 13, 6842 Bürstadt, Fed. Rep. of Germany

[21] Appl. No.: 905,542

[22] Filed: May 12, 1978

[30] Foreign Application Priority Data

Feb. 20, 1978 [DE] Fed. Rep. of Germany ..... 2807133
Mar. 31, 1978 [DE] Fed. Rep. of Germany ..... 2813901

[51] Int. Cl.[2] ..... D06P 5/12; D06P 7/00; A41D 1/14

[52] U.S. Cl. ..... 8/2.5 R; 8/2.5 A; 8/14; 2/211; 223/28; 223/33; 223/35

[58] Field of Search ..... 8/2.5 R, 2.5 A, 150, 8/148; 2/211; 223/28, 33, 35

[56] References Cited

U.S. PATENT DOCUMENTS

| | | | |
|---|---|---|---|
| 1,231,138 | 6/1917 | Dickman | 223/33 |
| 1,599,910 | 9/1926 | Mijer | 8/14 |
| 2,805,007 | 9/1957 | Aschbacher | 223/33 |
| 3,193,844 | 7/1965 | Eng | 2/211 |
| 3,644,969 | 2/1972 | Guillermin et al. | 8/148 |
| 3,868,214 | 2/1975 | Shackleton | 101/470 |
| 3,889,858 | 6/1975 | Hack | 223/35 |
| 3,922,445 | 11/1975 | Mizuno et al. | 8/2.5 R |
| 3,975,151 | 8/1976 | Berg et al. | 8/14 |

FOREIGN PATENT DOCUMENTS

| | | | |
|---|---|---|---|
| 2308508 | 12/1976 | France | 101/470 |
| 1243223 | 8/1971 | United Kingdom | 8/2.5 A |

OTHER PUBLICATIONS

Clarke, W., An Introduction to Textile Printing, Butterworth, London, 1974, pp. 240–243.
Redbook, Jun. 1970, pp. 81–82.

*Primary Examiner*—Joseph L. Schofer
*Assistant Examiner*—Maria S. Tungol

[57] ABSTRACT

A method of producing edge-printed, flare-pleated fabric garment pieces in which a fabric garment piece is placed in a corresponding pleating form and is held folded together with the form, thermal printing paper is so laid on the front edges of pleat creases visible in the form that its color-yielding face lies on the edges of the pleat creases, and in which pressure is applied to the back of the thermal printing paper with the simultaneous application of heat.

14 Claims, 3 Drawing Figures

Figure 3:
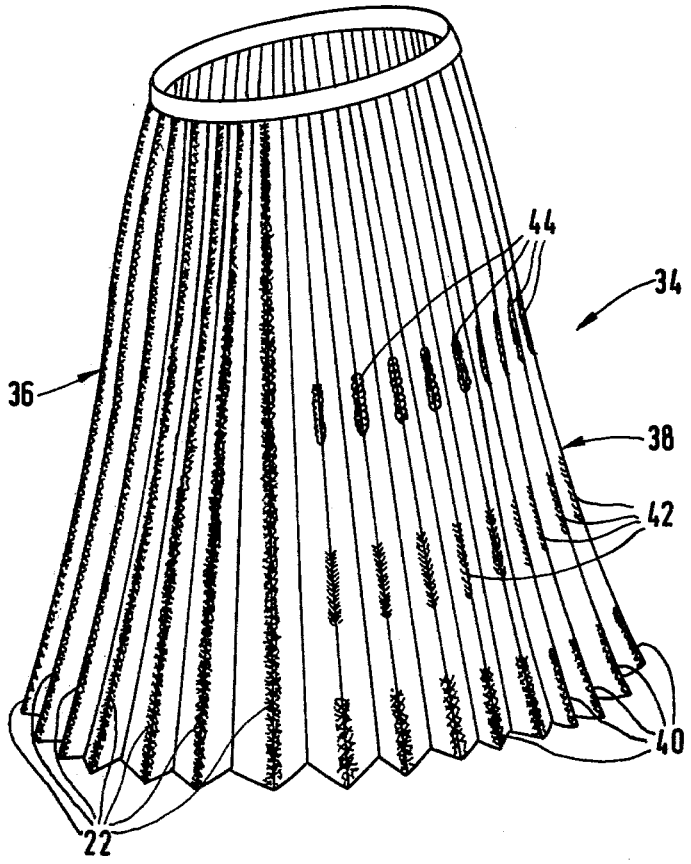

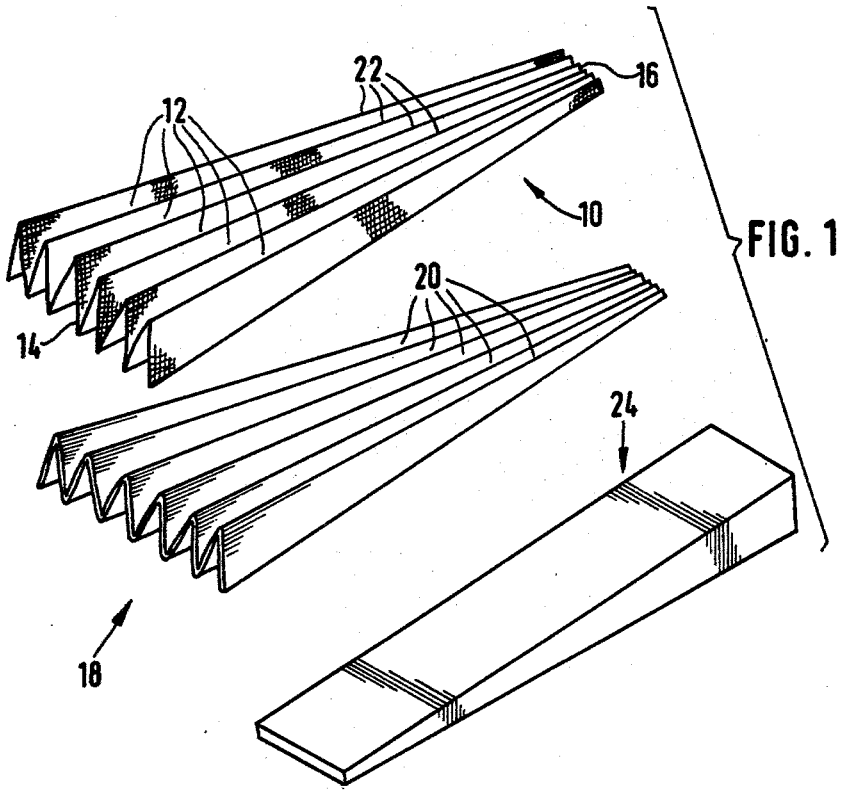
FIG. 1
FIG. 2
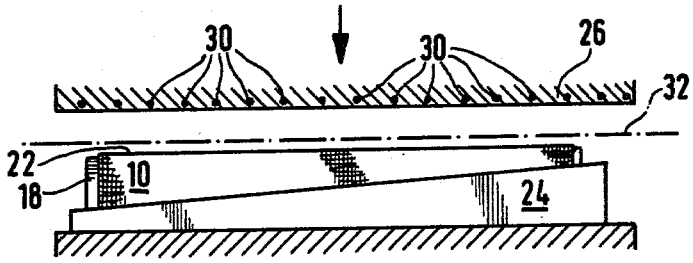

METHOD OF PRODUCING EDGE-PRINTED FABRIC GARMENT PIECES

This invention relates to a method of producing edge-printed, flare-pleated fabric garment pieces.

Women's pleated skirts, i.e., skirts having pressed and permanentized creases, are a firmly established article of women's fashions, even though they are sometimes more and sometimes less popular due to constant changes in fashion. In pleating, there is a distinction between what is called machine pleating, in which the pleats are of uniform depth over their entire length, so that they can be made mechanically in continuous straight pieces of fabric by machines especially developed for the purpose, and flare pleating, which is more difficult to produce, and which sets out from cut pieces of circular or arcuate configuration, since such pieces have to be provided with radially disposed pleats, i.e., pleats whose depth changes over their entire length. Flare-pleated garment pieces of this kind are used for making skirts whose pleats are considerably deeper in the area of the hem than they are in the waist portion, so that these skirts can "bell out" as the wearer turns. Machines with which such flare pleats can be manufactured economically have not yet been developed. Instead, the cut pieces of accurate configuration are laid manually into forms in which the pleats are pre-shaped, and then the pieces are subjected in these forms to the necessary heating and to the permanentizing process. The pleating forms are produced from stiff material, cardboard for example, to match the pleats to be produced, and are folded accordion-wise; after the cut piece of fabric has been inserted, the forms are compressed and are held in this compressed state during the heat treatment. It is readily apparent that it is virtually impossible to print the pieces before they are pleated, in such a manner that the printed pattern will be in a specific position in relation to the creases after they have been pressed, inasmuch as the position of the creases changes in the case of pieces cut for different sizes. For this reason it has been impossible hitherto to make pleated skirts in which the printed pattern is situated, for example, only inside the folds of the pleating or appears only on the front edge portion of the creases, while within the folds the color or the pattern previously printed on the fabric remains unaffected. But it is precisely such skirts that would provide a stylishly attractive effect, since the folds of pleated skirts open to a greater or lesser degree upon every movement of the wearer, i.e., the areas between the creases appear constantly to change in size.

THE INVENTION

The invention is addressed to the problem of creating a method for the production of printed, flare-pleated garment pieces, which will make it possible to do printing on the front edges of the creases, in precise alignment with the pleats, and thus to produce fabric garment pieces for novel and attractive skirts.

This object is achieved by the invention by laying a fabric garment piece into the corresponding pleating form and holding it folded together with the form, and by laying a thermal printing paper upon the front edges of the creases which are visible in the form, in such a manner that its printing face is in contact with the edges of the pleat creases, and exercising pressure on the back of the thermal printing paper with the simultaneous application of heat thereto. Monochromatic or polychromatic thermal printing papers, whose color or pattern can be transferred to the fabric by heat and pressure, are known. Hitherto, however, such thermal printing papers have been used for the flat printing of flat sheets of material. By the method of the invention, it is now possible for the first time to print flare-pleated pieces of fabric partially on the edges of the pleat creases and thus to achieve very attractive effects.

Inasmuch as the transfer of color from the thermal printing paper to the edges during the pressing process requires a very uniform application of heat and pressure, the procedure in a further development of the invention is to place the pleating form with the fabric folded therein, and the thermal printing paper, on a wedge-shaped equalizing body compensating for the taper of the folded pleating form, and then placing them between the plates of a thermal printing press, whereupon the heated press plate is brought into engagement with the thermal printing paper with the pressure required for transfer, and the pressure is maintained for the period of time required for the transfer of the color. By means of the equalizing bodies, the front edges of the creases which are to receive the imprint are aligned precisely parallel with the heated press plate, so that the required uniform pressure and heat application is assured.

Alternatively, the pleating form together with the fabric inserted therein and the superimposed thermal printing paper can be placed in a thermal printing press whose plates are set at an angle to one another or can be adjusted at an angle to one another such that they are or can be adjusted to an included angle corresponding to the slope of the pleating form, and then the heated press plate is brought into engagement with the thermal printing paper with the necessary pressure for the transfer of the imprint, and the pressure is maintained for the time required for the transfer of the imprint. The taper of the pleating form, therefore, is no longer compensated by an equalizing body, and is instead compensated by the angling of one of the plates of the thermal printing press, this angling of the press plates in relation to one another either being set permanently or, if pleating forms of different tapers often must be printed in the same thermal printing press, one of the press plates is disposed pivotingly in the frame of the press so that it will automatically angle itself in the pressing action.

To prevent an excessively high press pressure from crushing the pleating form, which is folded, as a rule, from stiff cardboard or the like, it is then recommendable, in further development of the invention, to insert along at least one side of the pleating form inserted between the plates of the thermal printing press a body of a wedge shape corresponding to the taper of the pleating form, such that the edges of the pleating form bearing the edges of the fabric to which the imprint is to be applied will project slightly above the corresponding upper side of the wedge-shaped body. This wedge-shaped body then will limit the stroke of the press to that which is required for the printing of the edges of the fabric.

In the practice of the method of the invention, a one-color thermal printing paper can be used which covers the entire length of the front edges of the pleat creases. A fabric garment piece will then be produced in which the front edges of the pleat creases are printed stripe-wise over their entire length.

Instead of a one-color thermal printing paper, a patterned thermal printing paper can be used, covering the entire length of the front edges of the pleat creases, in which case patterned stripes will be formed in the front edge area of the pleat creases.

On the other hand, it is also possible to lay thermal printing paper only on a portion of the entire length of the front edges of the pleat creases, in which case pieces will be produced in which the pleat creases will be only partially imprinted with stripes. Here, again, it is possible by the use of appropriate thermal printing papers to produce monochromatic or polychromatic stripes.

Furthermore, separate pieces of thermal printing paper can be laid on different portions of the pleat creases, so that in the subsequent pressing action each will transfer its color to only a portion of the front edges of the pleat creases. At the same time, the separate thermal printing paper pieces can have different colors and/or different patterns.

The invention will be further explained in the following description in conjunction with the drawing, wherein FIG. 1 is an exploded perspective representation of a piece of fabric, a corresponding pleating form, and an equalizing body for the edge printing process;

FIG. 2 is a diagrammatic representation of a side view of the edge printing process, and FIG. 3 is a perspective view of a woman's skirt which is made from flare-pleated pieces of fabric which have been edge-printed in the manner of the invention.

A piece of fabric 10 provided with flare-pleats 12 is shown at the top of FIG. 1. It can be seen that the pleats 12 have a greater depth at the end situated at the left hand side of the drawing than they have at the other end. The unfolded piece is accordingly arcuate at the two margins extending at right angles to the pleats, the margin 14 associated with the greater pleat depth at the bottom hem in the finished skirt having a considerably longer radius than the other, waist margin 16.

The corresponding pleating form 18 represented under the piece of fabric 10 is made of stiff sheet material folded to produce the illustrated accordion pleats 20, the pleats 20 changing in depth in accordance with the pleats 12 of the piece of fabric. In the pleating operation, the piece of fabric is laid onto the form 18 and pushed into the folds 20 thereof, and then the mold with the piece inserted is compressed and locked in the compressed position. Then the heat treatment required for the creasing of the fabric can be performed, as well as the permanentizing operation. The production of flare pleats in this manner is known.

According to the invention, however, the piece of fabric will be printed along its edges 22 which are seen at the top when the form 18 is compressed, the form 18 being placed, together with the inserted piece 10 and a wedge-shaped equalizing body 24 compensating for the taper of the compressed form 18, between two flat plates 26 and 28 of a thermal printing press. Of the press plates 26 and 28, at least the press plate 26 facing the edges 22 of the fabric which are to be printed is heated. In FIG. 2, in which the arrangement between the press plates 26 and 28 of the form 18 together with the inserted piece of fabric 10 and the compensating body 24 is represented diagrammatically, the fact that the upper plate 26 can be heated is indicated by the diagrammatically represented heating wires 30.

Between the edges 22 of the piece 10 and the press plate 26, thermal printing paper 32 is placed, which under pressure and simultaneous heating transfers the pattern provided on it to the edges 22 of the piece of fabric 10. Depending on the quality of the thermal printing paper and the amount of pressure applied, the temperature of the plate 26 and the time for which the pressure is applied, a greater or lesser amount of color is transferred from the paper to the pleat edges, color being also able to penetrate to areas of the fabric situated between the folds 20 of form 18, so that the printed stripes that will result will have a definite breadth which is not linearly limited to the extreme front edge of the pleat creases.

Instead of using the above-described wedge-shaped equalizing body 24 to compensate for the taper of the pleating form, one of the press plates of the thermal printing press can be set at a corresponding inclination.

In FIG. 3, two different possibilities for the edge printing of pleated fabric pieces in the manner of the invention are represented in conjunction with a woman's skirt 34. The left half 36 of the skirt 34 is made from one or more pieces of fabric, in which the front edges 22 of the creases are printed in one color over their entire length, while on the right half 38, partial edge portions 40, 42 and 44 at different heights are so printed that the printed edge portions make the skirt 34 appear to have horizontal stripes. The different methods used in hatching the printed edges at 40, 42 and 44 indicate that they can have different colors and/or patterns.

The left skirt half 36, which is to be considered as identical in character to the rest of the skirt, is made in the above-described manner by means of a monochromatic or patterned thermal printing paper laid upon the entire length of the front edges 22 of the fabric pieces 10 held in the form 18, while the pieces of material for the skirt half 38 represented on the right side, which is to be considered as identical in character to the rest of the skirt, is made by laying strips of thermal printing paper of the desired colors or patterns transversely of the edges 22 and then placing the heated press plate 26 on the thermal printing paper strips and applying pressure thereto.

It can be seen that the method of the invention is susceptible of further modifications whereby other optical and stylish printing effects can be produced. For example, thermal printing paper strips can also be placed obliquely to the edges 22 of the piece of fabric inserted in the form 18, or strips of printing paper of different colors or patterns can be used adjacent one another without spacing between them.

I claim:

1. Method of producing a fabric garment piece, comprising: placing a fabric garment piece already provided with flare pleats in a pleating form, holding said garment piece folded together with the form, laying thermal printing paper on the front edges of pleat creases visible in the form so that its color-yielding face lies on the edges of the pleat creases, placing the pleating form, including the flare-pleated garment piece placed therein and the thermal printing paper layed thereon, between the plates of a thermal printing press so that the front edges of the pleat creases extend parallel to the plates, thereafter placing the heated plates, with a pressure sufficient to effect transfer of color, onto the back face of the thermal printing paper placed on the edges, and maintaining the pressure for a time period required for transfer of color from the paper to the edges.

2. The method according to claim 1, comprising: placing the pleating form, together with the inserted piece of fabric garment and the superimposed thermal printing paper, first on a wedge-shaped equalizing body compensating the taper of the pleating form and then between the plates of a thermal printing press.

3. The method according to claim 1, comprising: placing the pleating form, together with the piece of fabric garment inserted in it and the superimposed thermal printing paper, in a thermal printing press whose plates are set at an angle relative to one another such that they are adjusted to one another at an angle corresponding to the taper of the pleating form.

4. The method according to claim 3, wherein, along at least one side of the pleating form inserted between the plates of the thermal printing press, a wedge-shaped body corresponding to the taper of the pleating form is placed such that the edges of the pleating form which bear the edges of the fabric piece which are to be printed project slightly above the corresponding upper side of the wedge-shaped body.

5. The method according to claim 1, comprising: placing the pleating form, together with the piece of fabric garment inserted in it and the superimposed thermal printing paper, in a thermal printing press whose pleats are adjustable at an angle relative to one another such that they adjust themselves to one another at an angle corresponding to the taper of the pleating form.

6. The method according to claim 5, wherein, along at least one side of the pleating form inserted between the plates of the thermal printing press, a wedge-shaped body corresponding to the taper of the pleating form is placed such that the edges of the pleating form which bear the edges of the fabric piece which are to be printed project slightly above the corresponding upper side of the wedge-shaped body.

7. The method according to any one of claims 1 to 6, wherein said paper is a one-color thermal printing paper which covers the entire length of the front edges of the pleat creases.

8. The method according to any one of claims 1 to 6, wherein said paper is a thermal printing paper bearing a polychrome pattern, which covers the entire length of the front edges of the pleat creases.

9. The method according to any one of claims 1 to 6, wherein said paper is a monochromatic thermal printing paper, which is laid only on a portion of the entire length of the front edges of the pleat creases.

10. The method according to any one of claims 1 to 6, wherein said paper is a polychromatically patterned thermal printing paper, which is laid only on a portion of the entire length of the front edges of the pleat creases.

11. The method according to any one of claims 1 to 6, wherein said paper has separate thermal printing paper sections which are laid upon different portions of the front edges of the pleat creases.

12. The method according to claim 11, wherein said separate thermal printing paper sections are of different color.

13. The method according to claim 11, wherein said separate thermal printing paper sections are of different pattern.

14. The method according to claim 11, wherein said separate thermal printing paper sections are of different color and of different pattern.

* * * * *